US006408078B1

(12) United States Patent
Hobelsberger

(10) Patent No.: US 6,408,078 B1
(45) **Date of Patent: *Jun. 18, 2002**

(54) ACTIVE REACTIVE ACOUSTICAL ELEMENTS

(76) Inventor: Maximilian Hobelsberger, Dorfstr. 16, Wuerenlingen, CH-5303 (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/548,384

(22) Filed: Apr. 12, 2000

Related U.S. Application Data

(63) Continuation-in-part of application No. 08/961,075, filed on Oct. 30, 1997.

(51) Int. Cl.[7] ..... H04R 3/00; H04R 29/00
(52) U.S. Cl. ..... 381/96; 381/59
(58) Field of Search ..... 381/55, 96, 59, 381/89

(56) References Cited

U.S. PATENT DOCUMENTS 5,461,676 A * 10/1995 Hobelsberger ..... 381/96
5,577,126 A * 11/1996 Klippel ..... 381/55
5,629,987 A * 5/1997 Hobelsberger ..... 381/96
6,088,459 A * 7/2000 Hobelsberger ..... 381/96

* cited by examiner

*Primary Examiner*—Forester W. Isen
*Assistant Examiner*—Brian Tyrone Pendleton

(57) ABSTRACT

The loudspeaker system uses an inner transducer for pressure control in the closed loudspeaker housing to simulate the desired baffle properties. The speed of the membrane of the inner transducer is either proportional to the derivative of the pressure, or proportional to the intergral of pressure changes, or comprises summands proportional to the pressure, to the pressure's derivative and to the pressure's intergral.

6 Claims, 2 Drawing Sheets

ACTIVE REACTIVE ACOUSTICAL ELEMENTS

CROSS-REFERENCE TO RELATED APPLICATIONS

This is a Continuation-in-Part of the application with Ser. No. 08/961,075, filed Oct. 30, 1997.

BACKGROUND OF THE INVENTION

1. Field of the Invention

This invention relates to systems which absorb noise or sound or influence the acoustical resonance behaviour of rooms and chambers. More particularly it relates to active systems to absorb noise or to influence room acoustics.

2. Prior Art

In some applications in the field of acoustics devices are needed which reflect or absorb acoustical waves in a specified way. Often these devices should not reflect any acoustical waves.

At high frequencies this specified behaviour, e.g. no reflection, can be achieved by simple, passive constructive means, i.e. the of use absorptive materials like foam rubber or glass wool, and by giving the non-reflecting surface a special shape. However at low frequencies the dimensions of absorptive structures get large and impractical.

Some passive resonant structures are known under the name "sound traps" (U.S. Pat. Nos. 2,502,020, 2,706,530, 4,319,661, 4,548,292, 5,210,383). These devices use passive resonators (e.g. Helmholtz-Resonators) which increase the ability to absorb sound of low frequency. However the dimensions are still in relation to the efficiency. The resonance frequencies are mainly defined by the dimensions of the resonance chambers. For low frequencies these dimensions must be large again.

Another related invention is Max Hobelsberger's device for simulation of an acoustical impedance (U.S. Pat. No. 5,812,686) which is used to establish a specified acoustical impedance. This device is an active device which uses an electroacoustic transducer which acts, together with a control system, as acoustical impedance.

SUMMARY OF THE INVENTION

It is an object of this invention to provide relatively small, active acoustical elements which can be used as building elements for the creation of sound absorbing systems.

The invented system follows the function principle, that the air pressure in a chamber inside a housing is influenced by an electroacoustic transducer together with control system in a predetermined manner which simulates certain chamber characteristics, e.g. a certain chamber volume.

The system comprises a housing with a front wall and an electroacoustic transducer arranged inside the housing. The front wall allows a pneumatic communication between inside and outside of the housing. For example it may be equipped with one or more openings which permit air to flow between inside and outside. Or it may be equipped with displaceable membranes which are moved by pressure differences between inside and outside the housing. The housing could be either of the closed type, or it could be a vented housing.

The inner transducer is built into an opening of an inner wall of the housing. This inner wall separates an air chamber which adjoins the holes in the outer wall from one or more other chambers within the housing. The inner transducer is preferably an electrodynamic transducer with membrane, similar to an electrodynamic loudspeaker, however other types of transducers may be used too. In case of an electrodynamic transducer its membrane is driven by a coil which is placed in the magnetic field of the transducer's magnet system. The inner transducer influences with the movement of its membrane the pressure inside the chamber which adjoins the front wall which is equipped with the holes. Pressure sensing means, e.g. a pressure sensor, is mounted inside this chamber to measure the air pressure which is influenced by the inner transducer and by the air pressure outside of the housing, i.e. in front of the front wall. The output signal of the pressure sensing means is conveyed to calculating means, i.e. a micro-processor or analog circuits comprising operation amplifiers, which produce further signals. These signals are applied as setpoint values of movement to a controller (microprocessor or analog circuit) which controls via a power amplifier the movement, e.g. the speed, of the inner transducer's membrane.

The controller forces the membrane of the inner transducer to move with momentary values of movement, e.g. with a speed, according to the setpoint values of movement. These setpoint values are calculated, based on the pressure values, in such a way that the desired acoustical properties are achieved.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
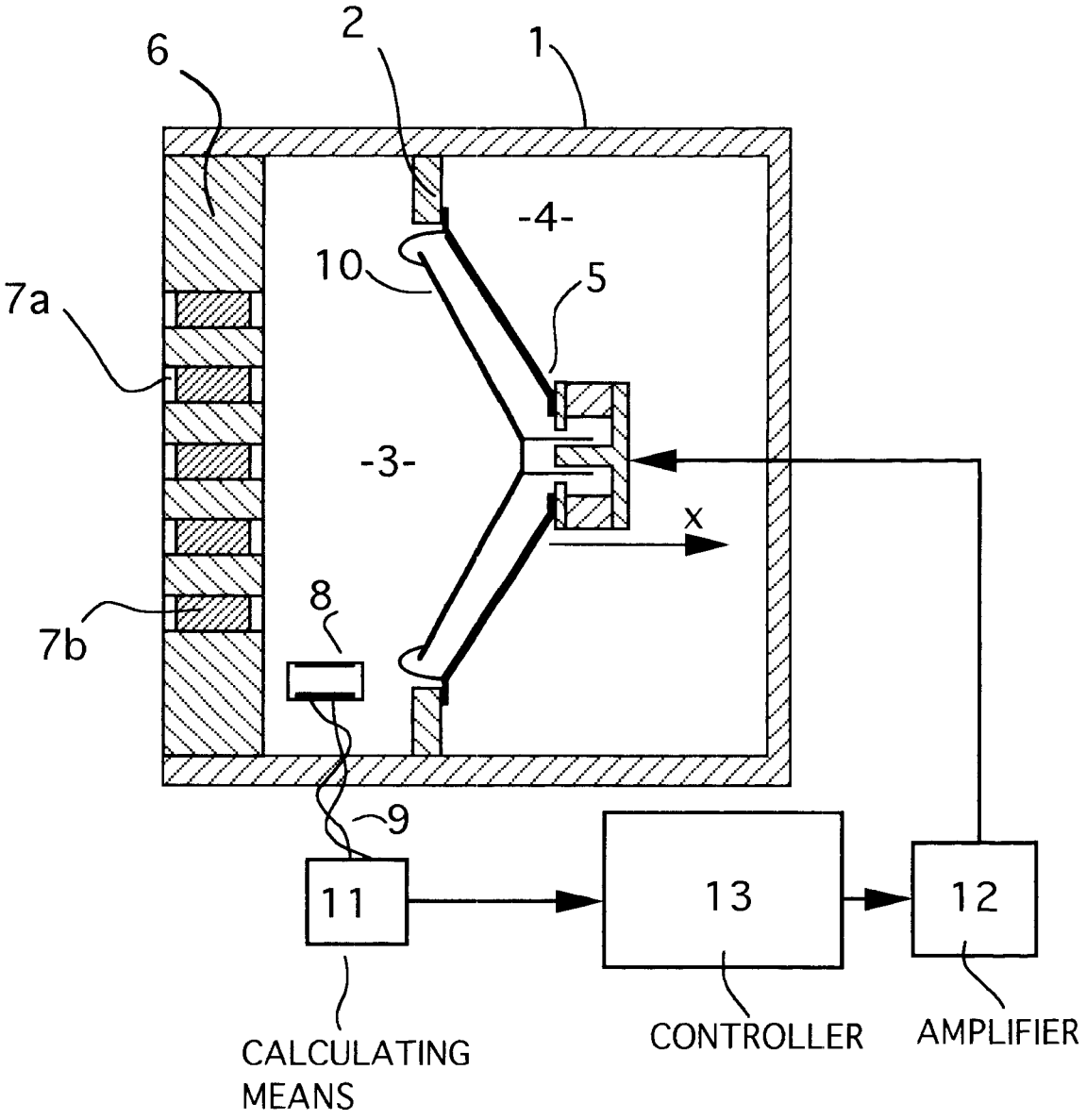
FIG. 1 is a schematic view of a reactive element that is a preferred embodiment of the present invention.

The following is a description of a first embodiment of the invention and refers to FIG. 1.

The housing 1 comprises two main chambers, 3, 4, seperated from each other by substantially soundproof and almost pressure-tight wall 2. "Chamber" means in this context a pneumatically interconnected space within the housing. A chamber could be just a single compartment, or a chamber could consist of a multitude of compartments which are pneumatically connected to each other via openings which allow an easy air flow between each other with low flow resistance. The chambers could be coupled to each other by membranes too. The first chamber, 3, is enclosed by the front wall 5, by first parts of the walls of the housing 1 and by the inner wall 2. The other chamber, 4, is enclosed by the inner wall 2 and second parts of the walls of the housing 1. An electroacoustic transducer 11 is built into an opening of the inner wall 2 so that its membrane 10 separates the chamber 3 from the chamber 4.

The inner chamber 18 is connected to the outside via openings 17*a* in the front wall 17. These openings are shaped and stuffed with sound absorbing material 17*b* in a way, that sound with higher frequencies is absorbed and attenuated. Sound with lower frequencies can pass into the inner chamber.

Pressure sensing means 8 is placed in the first chamber 3 which adjoins the the front wall. The air pressure in this chamber 3 is measured by the pressure sensing means and a signal s(t) is produced indicative of this pressure. The signal s(t) produced by the pressure sensing means is forwarded via wires 9 to calculating means 12. Calculating means can be of the digital type (microcontroller) or of the analog type (op. amps.). By the calculating means 12 a calculation is performed using the pressure sensing means' output signal m(t) value as input value for the calculation. Based on that input value a momentary output value w(t) is calculated which is forwarded to the controller 13 as setpoint value for the speed. This setpoint value w(t) determines how fast the membrane of the inner transducer should move, i.e. its speed. The controller drives via the power amplifier 14 the transducer's membrane 10. The controller is dimensioned to force the membrane to move with a membrane speed v(t) which is substantially equal to the momentary setpoint value for speed w(t) produced by the caclculator.

In the first embodiment the calculating means 12 calculate the output value w(t), i.e. the setpoint value for speed, as being proportional to the timely derivative dp(t)/d(t) of the measured air pressure p(t) in chamber 3.

$$w(t)=K*dp(t)/dt \tag{1}$$

So the resulting speed v(t) of the inner transducer's membrane in outwards direction of chamber 3 (incrementing values on the x-axis, or incrementing volume of chamber) equals the timely derivative of the air pressure in this chamber 3 multiplied by a chosen constant K. Constantly increasing pressure will cause a constant speed outwards of chamber 3.

$$v(t)=K*dp(t)/dt \tag{2}$$

With the assumption that the signal s(t) produced by the pressure sensing means is proportional to the air pressure p(t)

$$s(t)=L*p(t) \tag{3}$$

and the assumption that the controller controls the speed according to $$v(t)=A*w(t), \tag{4}$$

where

A is the amplification factor of the chain controller-amplifier-inner transducer, and w(t) is the setpoint value applied to the controller, the calculating means calculate the setpoint value w(t) based on the signal value s(t) according to $$w(t)=(1/A)*(1/L)*K*ds(t)/dt \tag{5}$$

Under these conditions the inner transducer simulates an hypothetical inner chamber with a "simulated" volume V which will be shown by the following equations:

In a chamber with physical volume $V_i$ the air pressure $p_i(t)$ depends on the additional air mass m(t) flowing into the chamber according to:

$$dp_i(t)/d(t)=B*m(t)/V_i \tag{6}$$

This is under the assumption of an isothermal compression. B is a factor of proportionality. It is further supposed that the hypothetical additional chamber is connected with the main chamber 3 without any pneumatical flow resistance so that $$p_i(t)=p(t). \tag{7}$$

This means that the air mass m(t) flowing into the additional chamber depends on the pressure p(t) according to $$m(t)=(V_i/B)*dp(t)/d(t)=R*dp(t)/d(t) \tag{8}$$

with R being another factor of proportionality.

The movement of the inner transducer's membrane causes exactly such an air mass flow if the controller forces the membrane to move with $$v(t)=K*dp(t)/dt \tag{1}$$

so that the air mass moved by the inner transducer's membrane is $$m(t)=C*F*v(t)=C*F*K*dp(t)/dt \tag{9}$$

with F being the surface of the membrane and C being another factor of proportionality.

This is the same behaviour as in equation (8), so the transducer behaves like an additional chamber with a simulated volume $V_i$. So the "effective" volume is increased (or decreased if a negative factor is chosen) by this configurable volume $V_i$.

An integration over time of equation (1) shows that the controller may control the membrane's excursion d(t) instead of the speed v(t) of the membrane to achieve equivalent results, i.e. to control the speed:

$$d(t)=\int v(t)*dt=K(p(t)-p_0) \tag{10}$$

So the excursion d(t) of the membrane, that is the deviation from the membrane's rest position without coil excitation, is proportional to the pressure deviation. This pressure deviation is the difference between the actual pressure p(t) and the mean pressure $p_0$ at rest of the system.

An other solution would be that the controller controls the acceleration a(t) of the membrane according to $$a(t)=K*d^2p(t)/dt^2 \tag{11}$$

According to (11) the acceleration would be proportional to the second derivative of the pressure.

All three solutions are equivalent. The controller can either control directly the speed, or it can control the position of the membrane, or it can control the acceleration of the membrane. Accordingly it will get different kinds of setpoint values. This is valid too for the embodiments described in the following text. The calculating means produce such setpoint values of movement (position, speed or acceleration values) that the controller forces the inner transducer's membrane to move with the desired speed.

In another embodiment of the invention the setpoint values for movement are such that the membrane's speed is not proportional to the timely derivative of pressure but proportional to the timely integral of the pressure deviations from the mean pressure $p_0(t)$, i.e. the pressure changes:

$$v(t)=K*\int(p(t)-p_0(t))*dt \tag{12}$$

This is equivalent to $$dv(t)/dt=K*(p(t)-p_0(t)) \tag{13}$$

According to (13) the acceleration of the membrane of the inner transducer depends on the pressure's deviation from the mean pressure. This is the behaviour of a mass with inertia. The inner transducer simulates an additional inner mass. So this is an "inductive" acoustical reactance if electrical analogies are used to dewscribe the effects.

In a third embodiment of the invention the setpoint values for movement are such that the speed of the membrane is proportional to a sum containing one or more of the following summands: Summands which are proportional to the timely derivative of the pressure, summands proportional to the timely integral of the pressure changes and summands proportional to the pressure itself:

$$v(t)U^*(K^* \mathcal{S}(p(t)-p_0(t))^*dt+L^*dp(t)/dt+M^*(p(t)-p_0(t)) \quad (14)$$

So the membrane's speed is direct proportional with U to a sum which contains summands, said summands being proportional with K to the timely integral of said air pressure changes, or proportional with L to the timely derivative of said air pressure, or proportional with M to the air pressure changes itself. This creates even more possibilities to influence the frequency characteristic of the loudspeaker system.

Figure 2:
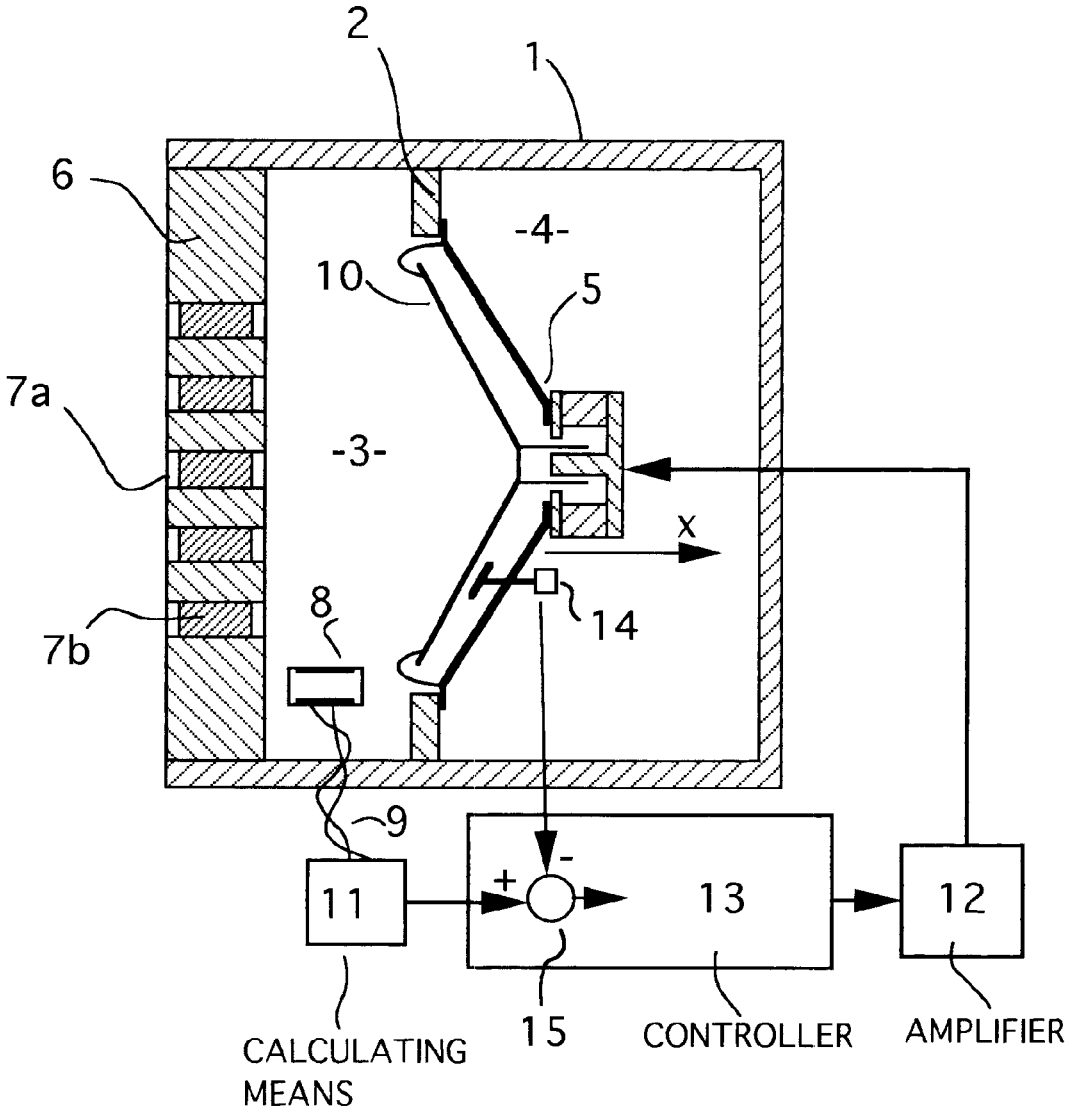
FIG. 2 is a schematic view of a reactive element that is another preferred embodiment of the present invention.

A further embodiment is shown in FIG. 2. It uses a closed loop speed control system for the inner transducer, or, more general a closed loop control system which controls the movement of the inner membrane. It comprises in addition to the above described components measuring means 16 to measure the membrane's momentary values of movement, e.g. a speed sensor or a position momentary values of movement, e.g. a speed sensor or a position sensor. The speed sensor measures the actual speed of the membrane 10. It should be understood that other sensors, e.g. acceleration sensors, can be used too to measure the movement of the membrane. If the acceleration is measured by the sensor the speed value can be gained by integration of the acceleration.

The output of the measuring means 16 is connected to the one input of the subtracting means 15. To the other input of the subtracting means the calculated setpoint value for speed is applied. So the actual speed value is subtracted from this calculated speed value which is applied as setpoint value. The resulting signal is further processed by the controller 13 which drives via the power amplifier 14 the transducer's membrane. The controller is dimensioned to hold the membrane's momentary speed equal to the calculated momentary speed setpoint. That means that the membrane's momentary speed depends mainly on the momentary pressure in chamber 2 according to the mathematical functions (1), (10) or (14).

It should be understood that instead of operating just with the speed also other values of the membrane's movement, e.g. acceleration and excursion, can be measured and used by the controller to control the movement of the membrane (state space controller). The controller can be a single-variable controller, or a multi-variable, multiloop topology may be used (e.g. state-space controller). Digital controllers (micro-processors) may be used as well as analog types (operational amplifiers). Generally spoken the controller tries to achieve equality between the calculated setpoint values of movement and the measured momentary values of movement. And the subtracting means could be replaced by other means for comparison.

To summarize, the "Reactive Acoustical Impedance Element" comprises the following main elements:

a) A housing, which separates an inner space from the outer surrounding;

b) Inner wall means for dividing the inner volume of said housing into at least two chambers. The wall means may be anything which acoustically separates, at least in the working frequency range of the element, the two chambers. Pressure waves from the backside of the transducers' membrane should not influence the front side of the membrane. The walls may be made of any rigid material (wood, plastics, metals, stones, ceramics for example) or be made of non-rigid materials like foam, fibers, textiles and so on.

The first of said chambers is pneumatically connected to the outside of the housing. This can be achieved directly through one or more holes in the outer wall of the housing. Or the outer wall may be equipped with one or more displaceable membranes. The main point is that changes of the air pressure outside of the housing cause changes of the air pressure in the first chamber. The holes may be equipped with some foam or fiber stuffing to achieve an attenuation of sound at higher frequencies.

c) At least one electromechanic transducer is built into openings of said inner wall means. The membranes of these transducers substantially close the openings, i.e. they separate said first chamber from a second chamber. The point is that air pressure in the second chamber has little effect on the air pressure in the first chamber.

d) Pressure sensing means which are placed in said first chamber. They are used for measuring the air pressure in said first chamber and for producing first signals indicative of said air pressure. The sensing means may be any sensor element which produces an electrical signal which is indicative of the air pressure, for example micromachined silicon sensors, piezo-sensors, electret sensors, all kinds of electromechanic sensors (capacitive, inductive, resistive, optical and so on).

e) Calculating means, which receive at their inputs the signals produced by the pressure sensing means. These calculating means produce output signals which are used as the setpoint values for the movement of the membranes of the inner transducers. Based on the received input signals of pressure these calculating means determine how fast the mebranes should move. It should be understood that "calculating means" and "amplifying means" is a purely functional separation, physically both functions could be performed by the same part, i.e. a power amplifier combined with a microprocessor. The calculating means (which could be an analog or digital model too) produce such output values that the speed of the transducers' membranes substantially equals the timely derivative of the pressure in the first chamber (or, in the other embodiments, the timely integral of pressure deviations, or a sum comprising both summands, derivative and intergal).

f) A control system, which controls the movement of the membranes of the electrodynamic transducers such that the speed of the membranes substantially equals the setpoint values applied to the control system's inputs. The control system comprises one or more electric power amplifiers, the outputs of these amplifiers being connected to the electrodynamic transducers to drive them, i.e. to supply electrical energy to move the membranes. It further comprises one or more electrical controllers, to the inputs of which the output signals produced by the calculating means are applied as setpoint values for movement. The outputs of said electrical controllers are electrically connected to the inputs of said power amplifiers. All in all the calculating means and the electrical controllers, that is the whole signal chain, are dimensioned to force said transducers' membranes to move with a speed which is substantially proportional to the timely derivative (or integral of the deviations or the summand of both, or to a sum which contains the derivative, the integral and a summand which is proportional to the pressure deviations) of the air pressure in the first chamber. It should be noted that the controllers may be of the adaptive type which adjusts to changes in the transfer characteristics.

g) The control system may be of the closed-loop control type, in which case the system further comprises measuring means (position sensors, speed sensors or accelerometers) for measuring the movement of said transducers' membranes and for producing signals indicative of this movement. The electrical controllers receive at their inputs the signals produced by said calculating means and also the signals produced by said movement measuring means. The signals produced by said calculating means are applied as setpoint values for movement of said transducers'membranes. The controllers control the movement of said membranes by processing and evaluating the differences between the setpoint values for movement and the signals received from said movement measuring means and by producing appropriate output signals based on this processing and evaluation of differences.

While the present invention has been described in connection with particular embodiments thereof, it will be understood by those skilled in the art that many changes and modifications may be made without departing from the true spirit and scope of the present invention. Different types of housings, of transducers, of sensors, of controls system topologies may be used. Therefore, it is intended by the appended claims to cover all such changes and modifications which come within the true spirit and scope of this invention.

What is claimed is:

1. Reactive acoustical impedance element, comprising a housing, inner wall means for dividing the inner volume of said housing into at least two chambers, wherein the first of said chambers is pneumatically connected to the outside of the housing, at least one electromechanic transducer, being built into an opening of said inner wall means such that its membrane separates said first chamber from a second chamber, pressure sensing means being placed in said first chamber, for measuring the air pressure in said first chamber and for producing first signals indicative of said air pressure, calculating means, to the input of which said first signals produced by said pressure sensing means are applied, for calculating output signals based on the values of said first signals, a control system, for controlling the movement of said membranes of said electrodynamic transducers, comprising one or more power amplifiers, the outputs of said amplifiers being connected to said electrodynamic transducers to drive said transducers, one or more electrical controllers, to the inputs of which said output signals produced by said calculating means are applied, the outputs of said electrical controllers being connected to the inputs of said power amplifiers, wherein said calculating means and electrical controllers are dimensioned to force said transducers' membranes to move with a speed which is substantially proportional to the timely derivative of the air pressure in said first chamber.

2. Device according to claim 1, wherein said control system is of the closed-loop control type, further comprising measuring means for measuring the movement of said transducers' membranes and for producing signals indicative of this movement, wherein said electrical controllers receive at their inputs the signals produced by said calculating means and the signals produced by said movement measuring means, wherein said signals produced by said calculating means are applied as setpoint values for movement of said transducers' membranes, and wherein said controllers control the movement of said membranes by processing the differences between said setpoint values for movement and said signals received from said movement measuring means.

3. Reactive acoustical impedance element, comprising a housing, inner wall means for dividing the inner volume of said housing into at least two chambers, wherein the first of said chambers is pneumatically connected to the outside of the housing, at least one electromechanic transducer, being built into an opening of said inner wall means such that its membrane separates said first chamber from a second chamber, pressure sensing means being placed in said first chamber, for measuring the air pressure in said first chamber and for producing first signals indicative of said air pressure, calculating means, to the input of which said first signals produced by said pressure sensing means are applied, for calculating output signals based on the values of said first signals, a control system, for controlling the movement of said membranes of said electrodynamic transducers, comprising one or more power amplifiers, the outputs of said amplifiers being connected to said electrodynamic transducers to drive said transducers, one or more electrical controllers, to the inputs of which said output signals produced by said calculating means are applied, the outputs of said electrical controllers being connected to the inputs of said power amplifiers, wherein said calculating means and electrical controllers are dimensioned to force said transducers' membranes to move with a speed which is substantially proportional to the timely integral of the air-pressure deviations in said first chamber.

4. Device according to claim 3, wherein said control system is of the closed-loop control type, further comprising measuring means for measuring the movement of said transducers' membranes and for producing signals indicative of this movement, wherein said electrical controllers receive at their inputs the signals produced by said calculating means and the signals produced by said movement measuring means, wherein said signals produced by said calculating means are applied as setpoint values for movement of said transducers' membranes, and wherein said controllers control the movement of said membranes by processing the differences between said setpoint values for movement and said signals received from said movement measuring means.

5. Reactive acoustical impedance element, comprising a housing, inner wall means for dividing the inner volume of said housing into at least two chambers, wherein the first of said chambers is pneumatically connected to the outside of the housing, at least one electromechanic transducer, being built into an opening of said inner wall means such that its membrane separates said first chamber from a second chamber, pressure sensing means being placed in said first chamber, for measuring the air pressure in said first chamber and for producing first signals indicative of said air pressure, calculating means, to the input of which said first signals produced by said pressure sensing means are applied, for calculating output signals based on the values of said first signals, a control system, for controlling the movement of said membranes of said electrodynamic transducers, comprising one or more power amplifiers, the outputs of said amplifiers being connected to said electrodynamic transducers to drive said transducers, one or more electrical controllers, to the inputs of which said output signals produced by said calculating means are applied, the outputs of said electrical controllers being connected to the inputs of said power amplifiers, wherein said calculating means and electrical controllers are dimensioned to force said transducers' membranes to move with a speed which is substantially proportional to a sum which comprises at least two summands selected from the group consisting of a first summand being substantially proportional to the timely integral of said air pressure deviation from the mean pressure, a second summand being substantially proportional to the timely derivative of said air pressure, a third summand being substantially proportional to said air pressure deviation.

6. Device according to claim 5, wherein said control system is of the closed-loop control type, further comprising measuring means for measuring the movement of said transducers' membranes and for producing signals indicative of this movement, wherein said electrical controllers receive at their inputs the signals produced by said calculating means and the signals produced by said movement measuring means, wherein said signals produced by said calculating means are applied as setpoint values for movement of said transducers' membranes, and wherein said controllers control the movement of said membranes by processing the differences between said setpoint values for movement and said signals received from said movement measuring means.

* * * * *